United States Patent [19]

MacKay, Jr.

[11] Patent Number: 4,760,670

[45] Date of Patent: Aug. 2, 1988

[54] DISPOSABLE DEPRESSED CENTER GRINDING WHEEL HAVING AN INTEGRAL MOUNTING HUB

[76] Inventor: Joseph H. MacKay, Jr., 17551 Cabela Dr., San Diego, Calif. 92127

[21] Appl. No.: 5,812

[22] Filed: Jan. 21, 1987

Related U.S. Application Data

[63] Continuation-in-part of Ser. No. 847,793, Apr. 3, 1986, Pat. No. 4,694,615.

[51] Int. Cl.[4] ..... B24B 45/00

[52] U.S. Cl. ..... 51/168; 51/209 R; 51/378; 15/230.18

[58] Field of Search ..... 51/168, 209 R, 358, 51/376, 377, 378, 389; 15/230.18, 230.19

[56] References Cited

U.S. PATENT DOCUMENTS

| | | | |
|---|---|---|---|
| 489,149 | 1/1893 | Hyde | 51/168 |
| 2,278,301 | 3/1942 | Bauer | 51/209 R |
| 3,041,797 | 7/1962 | Moffly . | |
| 3,136,100 | 6/1964 | Robertson | 51/209 R |
| 3,879,178 | 4/1975 | Bosma | 51/168 |
| 4,322,920 | 4/1982 | Wells | 51/358 X |
| 4,439,953 | 4/1984 | Block et al. | 51/389 |

*Primary Examiner*—Robert P. Olszewski

*Attorney, Agent, or Firm*—Nilsson, Robbins, Dalgarn, Berliner, Carson & Wurst

[57] ABSTRACT

A disposable depressed center grinding wheel for mounting on a rotatable threaded spindle of a power tool. The grinding wheel contains a retaining nut on one side and a backing flange on the other non-removably secured together on the grinding wheel without the aid of adhesives in such a manner that the grinding wheel is placed in compression when it is operably secured upon the spindle of the power tool under grinding loads. The nut and flange are secured together by upsetting one end of the nut causing it to protrude outwardly over the outer surface of the flange. A base member is loosely secured to the spindle of the power tool for engaging the outer surface of the backing flange during operation of the grinding wheel.

16 Claims, 2 Drawing Sheets

DISPOSABLE DEPRESSED CENTER GRINDING WHEEL HAVING AN INTEGRAL MOUNTING HUB

RELATED APPLICATION

This application is a continuation-in-part of U.S. patent application Ser. No. 847,793, filed Apr. 3, 1986 now U.S. Pat. No. 4,694,615 for DISPOSABLE DEPRESSED CENTER GRINDING WHEEL HAVING AN INTEGRAL MOUNTING HUB.

FIELD OF THE INVENTION

This invention relates generally to abrasive finishing articles and more particularly to abrasive wheel assemblies having a depressed center abrasive wheel with a mounting hub permanently affixed thereto with the combination adapted for attachment to an appropriate portable power tool.

BACKGROUND OF THE INVENTION

The use of rotatably driven grinding wheels is widespread and familiar in our industrial society. One of the more serious problems encountered in the use of such devices resides in the provision of effective means for preventing undesired or accidental disassociation of the grinding wheel from the shaft, spindle or other rotatable drive means on which it is mounted. This problem is particularly acute when the connection between the grinding wheel and its driving shaft or spindle is intentionally detachable to facilitate quick removal and replacement of the grinding wheel. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,601,661; 791,791; 872,932; 2,567,782; 3,136,100, 3,210,892 and 3,621,621.

The devices utilized in the prior art for providing the disposable grinding wheel assembly including the permanent affixed mounting hub generally provide the service intended. There are certain inherent disadvantages found with regard to the various devices. Such disadvantages are that in manufacturing the utilization of an adhesive adds additional materials and labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the grinding wheel as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a rotatable spindle of a power tool. The drive member includes a backing flange on one side of the wheel and a retaining nut positioned on the opposite side of the finishing article from the backing flange. The nut extends through an opening from the face toward the back of the finishing article and has a radial flange at one end thereof seated against the face of the article and protrusion means extending from the other end thereof for non-removable securing the retaining nut and the backing flange together on the finishing article without the use of adhesives. Loosely retained upon the power tool spindle is a base member which engages the outer surface of the backing flange to apply pressure to the flange during operation of the finishing article. More particularly, the securing means and the base member are adapted to cause the nut and backing flange to place the finishing article in compression when the finishing article is operatively secured upon the spindle of the power tool.

DETAILED DESCRIPTION

Figure 1:
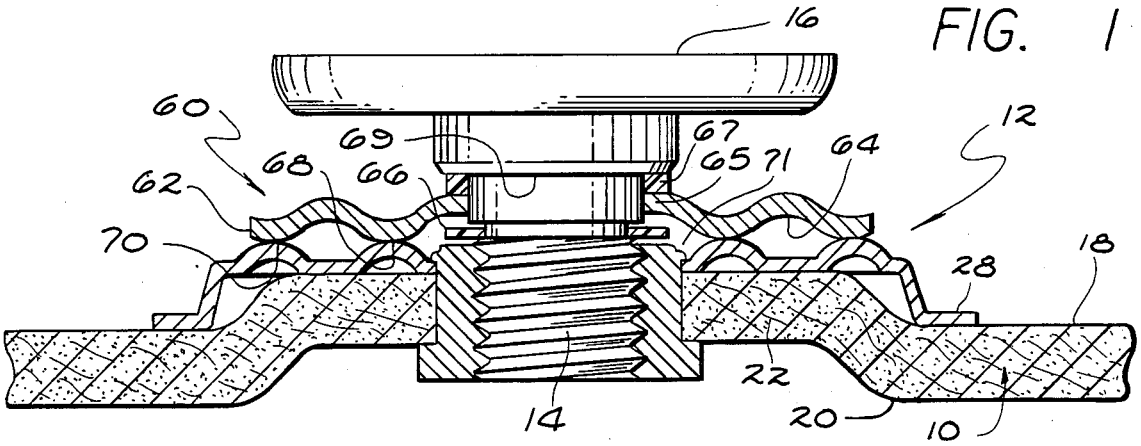
FIG. 1 is a cross sectional view of a disposable grinding wheel assembly constructed in accordance with the principles of the present invention and mounted in operable position on the spindle of a power tool.

By reference now more specifically to FIGS. 1 through 5, there is illustrated a preferred embodiment of a disposable grinding wheel-drive member assembly constructed in accordance with the principles of the present invention. As is therein shown a depressed center grinding wheel 10 has a disposable drive member assembly 12 permanently affixed thereto so that the grinding wheel may be attached to the spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force which is applied to the grinding wheel during utilization thereof, the greater the operational compression becomes. As a result of placing the grinding wheel in such compression the grinding wheel is maintained upon the spindle and cannot fly off and at the same time, through the compression or clamping force as applied, the drive wheel 10 cannot rotate relative to the driving member or hub 12. However, as a result of the construction of the driving member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed form the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. A pair of reinforcing ribs 32 and 34 are formed in the backing flange 28 concentrically with the opening 30. The backing flange 28 is preferably stamped from sheet metal but of course could be constructed from other materials such as hard molded plastic or die cast metal should such be desired.

Figure 3:
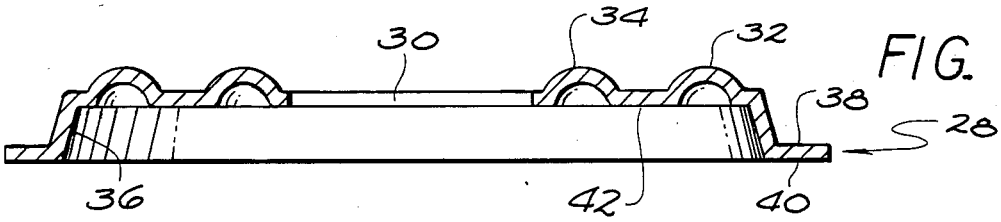
FIG. 3 is a cross sectional view of a backing flange constructed in accordance with the present invention.
Figure 4:
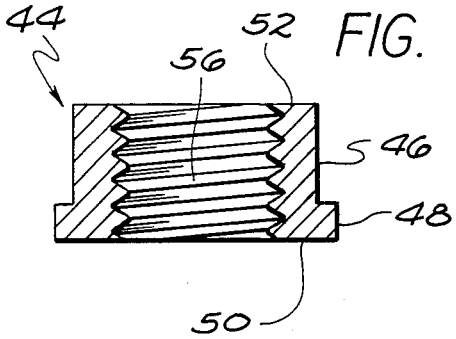
FIG. 4 is a cross section view of a retaining nut constructed in accordance with the principles of the present invention.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes a pair of lands 40 and 42. The land 40 always is formed about the outer peripheral portion of the backing flange 28. The land 42 is displaced inwardly toward the opening 30 and away from the land 40. The land 40 engages the back surface 18 of the abrasive finishing wheel away from the depressed center while the land 42 may engage the back surface of the abrasive finishing wheel 10 opposed the depressed center 22 thereof depending upon variations in wheel dimensions and manufacturing tolerances in the wheel and flanges.

As can be seen, particularly in FIG. 3, the ribs 32 and 34 formed in the outer surface 38 of the backing flange 22 are continuous. The continuous rib 32 is disposed between the lands 40 and 42 and over the transitional area between the depressed center and the remainder of the grinding wheel 10 while the continuous rib 34 is disposed intermediate the opening 30 and the land 42.

A retainer nut 44 includes a body portion 46 which is hollow and has a radially outwardly extending flange 48 at a first end 50 thereof. At the opposite or second end 52 of the body and slightly displaced therefrom there is provided a recess such as a continuous groove 54 which is formed at the time of assembly after the body 46 is inserted through the openings in the wheel 10 and backing flange 28. The internal surface of the body 46 has threads 56 formed therealong for attachment to the threaded spindle 14 of the power tool. The nut 44 is inserted through the aperture 26 in the grinding wheel and the aperture 30 in the flange 28 from the front 20 toward the rear 18 of the grinding wheel 10. The end 52 of the nut 44 extends through the opening 30 in the flange 28 for a distance not exceeding the top of the rib 34.

Figure 5:
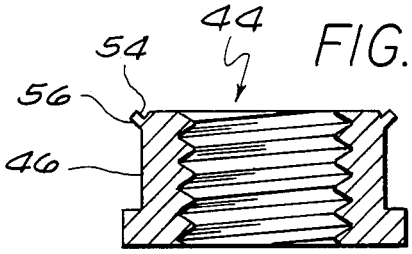
FIG. 5 is a cross sectional view of the retaining nut of FIG. 5 after being upset.

Once the nut 44 has been inserted through the openings in the wheel 10 and the flange 28, the end 52 thereof is upset such as by a staking operation to provide the continuous groove 54 as shown specifically in FIG. 5. The upsetting operation causes a protrusion 56 to extend outwardly from the body 46 in such a manner as to engage the flange 28 about the outer surface 38 thereof adjacent the opening 30 therethrough and is the only means used for securing the flange 28 and the nut 44 on the wheel 10. The protrusion 56 is illustrated as being continuous as is the groove 54, although it should be understood that it may be intermittent should such be desired. It should become apparent to those skilled in the art that the flange 28 and the nut 44 are mechanically secured together on the wheel 10 between the flange 48 and the protrusion 56 without the use of adhesives.

The nut 44 is preferably constructed from an aluminum extrusion which is then machined to provide the flange 38 and the threads 46. Alternatively the nut may be formed from aluminum or steel bar stock, or a metal die casting.

To provide proper operation of the throw-away grinding wheel as described, there is provided a base assembly 60 which includes a disc 62 having a first surface 64 at least part of which is adapted for engaging the outer surface 38 of the flange 28. The disc 62 is held in place on the spindle 14 by a retaining member 66 which, as shown in FIG. 1 in the preferred embodiment, may be a nylon washer which is threadable onto the threaded spindle 14. The nylon washer 66 will then loosely retain the disc 62 upon the spindle 14 at all times whether or not a grinding wheel is maintained in place.

The first surface 64 of the disc 62 defines continuous ridges 68 and 70 which engage the ribs 34 and 32, respectively, of the flange 28 as can be seen. The contact between the ribs and ridges is essentially a line contact. As a result of the line contact the wheel 10 may usually be relatively easily removed from the power tool 16. However, because of the tremendous amount of force which may have been exerted by the disc 62 during the grinding operation the spent wheel may sometimes be difficult to remove.

Positioned between the opposite surface 65 of the disc 62 and the shoulder 69 on the power tool 16 is a plastic washer 67 constructed preferably of a self lubricating plastic. The washer 67 serves two functions. The first function is to accommodate power tools 16 of varying dimensional configurations. That is, the spindle 14 may vary in length requiring spacers to assure the end of the spindle does not protrude beyond the end of the nut 44 by any substantial amount. The second function is to assist in removal of the wheel 10 from the power tool 16 after the wheel 10 is spent. Since tremendous forces are generated during a grinding operation, metal-to-metal surfaces, particularly of similar types, tend to bind or gall thereby necessitating the application of relatively large forces to remove the spent wheel. The self lubricating dissimilar surfaces between the washer 67 and shoulder 69 and surface 65 provides an almost immediate release upon the application of minimal pressure to wheel 10. Thereafter the line contact above referred to allows easy separation of the wheel from the base assembly 60.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the ridges 68 and 70 engage in a line fashion the ribs 34 and 32 on the flange. The flange is forced in a downward direction by such engagement. At the same time the interengagement between the threads 14 and 56 of the spindle and nut, respectively, urge the nut upward toward the flange 28 to cause the grinding wheel to be placed in compression. An examination of the drawings, particularly FIG. 1, will disclose that when the grinding wheel is in operation forces are transmitted downwardly from the power tool 16, the washer 67, the disc 62 and the land 40 of the flange 28. At the same time, forces are being applied upwardly through the flange 48 on the nut 44. These forces are generated through the threaded engagement between the spindle 14 and the interior 56 of the nut 44 through application of torque to the rotating wheel when it is placed into engagement with a workpiece. Those skilled in the art will recognize that as the grinding wheel 10 is used by being placed against a workpiece additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which is turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. It should also be noted that the inner surface 64 of the disc 62 provides a space or chamber 71 above the top 52 of the nut 44. This chamber 71 provides room for the nut to move upwardly during operation in a manner unrestricted by the power tool or base assembly.

Figure 6:
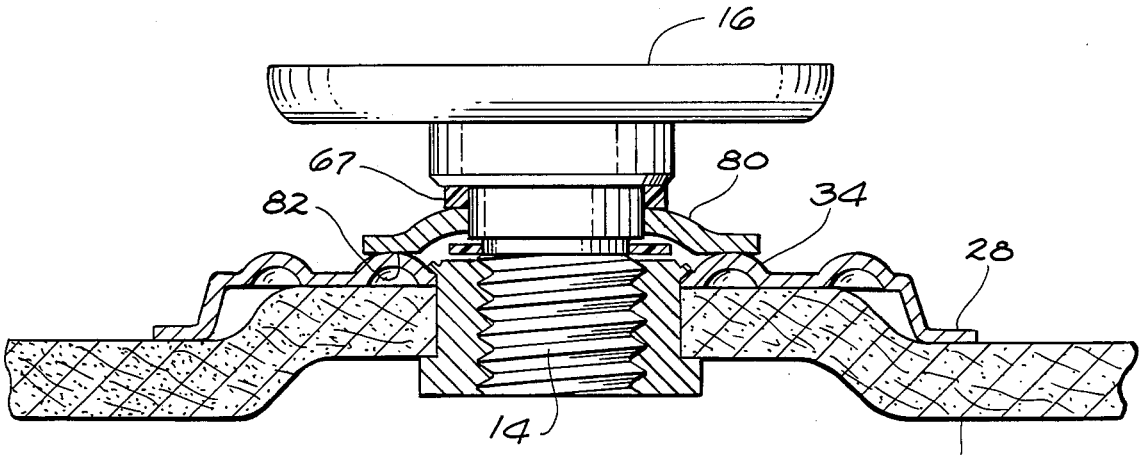
FIG. 6 is an alternative construction of a spindle base assembly constructed in accordance with the present invention for use on small grinding wheels.
Figure 2:
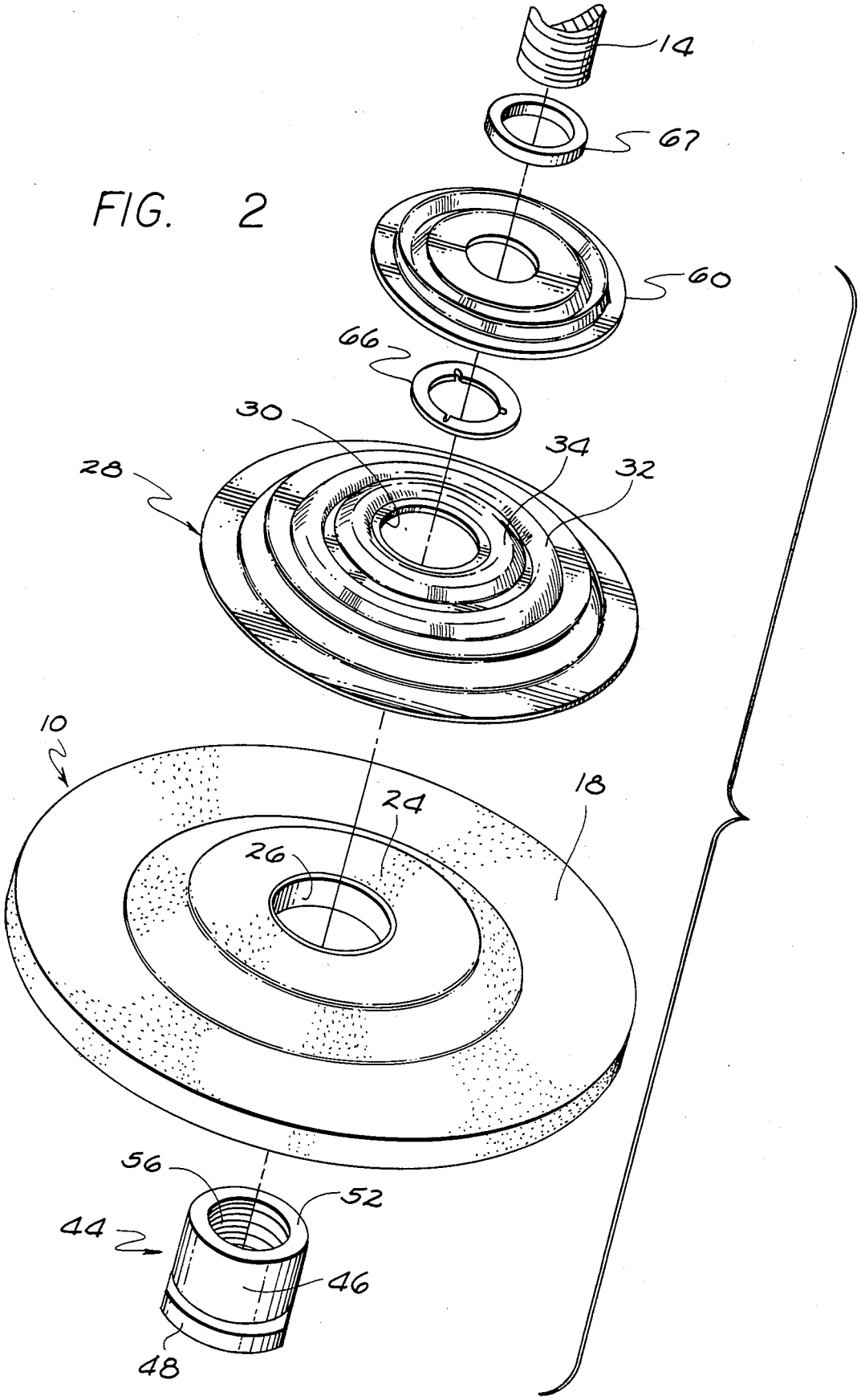
FIG. 2 is an exploded view of the structure as illustrated in FIG. 1.

FIG. 6 illustrates an alternative structure similar to that shown in FIG. 1 but specifically designed for use with smaller grinding wheels, for example, those having a diameter of five inches or less. The only difference is that the disc in the base assembly is of smaller diameter and designed to engage only the first rib adjacent the opening through the backing flange. As is shown, the disc 80 defines a peripheral surface 82 which engages the top surface of the continuous rib 34 on the backing flange 28. It has been found that the smaller grinding wheels do not require the larger backing flange for satisfactory operation although it should be understood that the smaller grinding wheels operate satisfactorily with the larger backing flanges.

It will be recognized by those skilled in the art that the grinding wheel assemblies as illustrated in FIGS. 1 through 6 and as above described requires no adhesive for construction and may be simply and easily assembled, is relatively light in weight as compared to the prior art devices utilizing the cast hubs and provides a secure attachment of the grinding wheel to the power tool and through the utilization of the increased compression precludes relative rotation of the grinding wheel with regard to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Through the structures as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable grinding wheel-driving member assembly which securely holds the grinding wheel during operation, which is light in weight, vibration-free, and less expensive than prior art throw-away grinding wheels while meeting all safety standards currently known and in existence.

What is claimed is:

1. A finishing article having a disposable drive member non-removably affixed thereto for mounting on a threaded rotatable spindle of a power tool comprising:

a finishing article having a face and a back and having a first centrally disposed aperture therethrough:

a backing flange having an inner and outer surface and a diameter smaller than the diameter of said finishing article and defining a second centrally disposed aperture therethrough, at least a portion of said backing flange inner surface seated on said back of said finishing article with said first and second apertures alinged;

a retaining nut having a hollow internally threaded body having first and second ends and a first radially outwardly extending flange extending from said first end of said body, said body extending through said first and second apertures from said face toward said back of said finishing article with said radial flange seated against said face;

means protruding outwardly from said second end of said body to non-removably secure said retaining nut and said backing flange together on said finishing article without the use of adhesive and allowing relative axial movement between said retaining nut and said backing flange; and base means for attachment to said threaded spindle for engaging at least a portion of said outer surface of said backing flange when said finishing article is threadably affixed to and seated on said spindle to apply force to said backing flange, so that relative axial movement between said retaining nut and said backing flange toward each other is permitted to thereby increasingly compress said finishing article between said outwardly extending flange on said nut and said backing flange as operative loads are applied to said article during use on said power tool.

2. A finishing article as defined in claim 1 wherein said outwardly protruding means includes at least a portion of said second end of said body.

3. A finishing article as defined in claim 2 wherein said portion of said body includes a continuous ring seated against said backing flange.

4. A finishing article as defined in claim 3 wherein said second end of said body is upset to provide said continuous ring.

5. A finishing article as defined in claim 4 wherein said backing flange inner surface disposed opposed said back of said finishing article includes an outer peripheral land, said land contacting said back of said finishing article.

6. A finishing article as defined in claim 5 wherein said outer surface of said backing flange includes rib means extending therefrom.

7. A finishing article as defined in claim 6 wherein said rib means includes first and second continuous ribs.

8. A finishing article as defined in claim 7 wherein said backing flange is formed of sheet metal and said land and ribs are formed by stamping said sheet metal back flange.

9. A finishing article as defined in claim 6 wherein said base means includes a disc having a first surface for engaging said rib means and means for loosely retaining said disc on said spindle in the absence of a finishing article.

10. A finishing article as defined in claim 9 wherein said disc first surface defines continuous ridge means for engaging said rib means substantially in line contact.

11. A finishing article as defined in claim 10 wherein said means for loosely retaining said disc on said spindle is a washer member formed of plastic.

12. A finishing article as defined in claim 10 wherein said rib means includes first and second continuous ribs and said disc includes first and second ridges for engagement with said first and second ribs substantially in line contact.

13. A finishing article as defined in claim 1 wherein said base means further includes washer means disposed adjacent said spindle on said power tool.

14. A finishing article as defined in claim 13 wherein said washer is constructed of material which is dissimilar to said power tool.

15. A finishing article as defined in claim 14 where in said washer is plastic.

16. A finishing article as defined in claim 15 wherein said washer is a self-lubricating plastic.

* * * * *